US009321143B2

(12) United States Patent
Ronshaugen et al.

(10) Patent No.: US 9,321,143 B2
(45) Date of Patent: Apr. 26, 2016

(54) LAPPING DEVICE WITH LAPPING CONTROL FEATURE AND METHOD

(71) Applicant: Seagate Technology LLC, Cupertino, CA (US)

(72) Inventors: Marc Perry Ronshaugen, Eden Prairie, MN (US); Gordon Merle Jones, Faribault, MN (US); Robert Edward Chapin, Burnsville, MN (US)

(73) Assignee: Seagate Technology LLC, Cupertino, CA (US)

( * ) Notice: Subject to any disclaimer, the term of this patent is extended or adjusted under 35 U.S.C. 154(b) by 134 days.

(21) Appl. No.: 14/048,326

(22) Filed: Oct. 8, 2013

(65) Prior Publication Data

US 2015/0099426 A1 Apr. 9, 2015

(51) Int. Cl.

*B24B 37/34* (2012.01)
*B24B 37/30* (2012.01)
*B24B 49/00* (2012.01)

(52) U.S. Cl.

CPC ..... *B24B 37/345* (2013.01); *B24B 37/30* (2013.01); *B24B 49/00* (2013.01)

(58) Field of Classification Search

CPC ..... B24B 37/00; B24B 37/04; B24B 37/10; B24B 37/105; B24B 37/107; B24B 37/27; B24B 37/30; B24B 37/34; B24B 37/345
USPC ..... 451/11, 12, 14, 41, 285, 287, 288
See application file for complete search history.

(56) References Cited

U.S. PATENT DOCUMENTS

| | | | | |
|---|---|---|---|---|
| 3,659,386 | A * | 5/1972 | Goetz et al. | 451/37 |
| 5,681,212 | A * | 10/1997 | Hayakawa et al. | 451/288 |
| 6,231,428 | B1 | 5/2001 | Maloney et al. | |
| 6,261,165 | B1 | 7/2001 | Lackey et al. | |
| 7,271,888 | B2 * | 9/2007 | Frodis et al. | 356/237.1 |
| 8,328,600 | B2 | 12/2012 | Duescher | |
| 2011/0159782 | A1 * | 6/2011 | Sone et al. | 451/7 |
| 2012/0270478 | A1 | 10/2012 | Duescher | |

FOREIGN PATENT DOCUMENTS

| | | |
|---|---|---|
| JP | 2002008218 | 1/2002 |

* cited by examiner

*Primary Examiner* — Monica Carter
*Assistant Examiner* — Lauren Beronja
(74) *Attorney, Agent, or Firm* — Westman, Champlin & Koehler, P.A.

(57) ABSTRACT

A head structure for a lapping assembly including a lapping control feature is disclosed. The lapping control feature includes a raised contact surface elevated from a front surface of the head structure of the lapping assembly. A relative position of the workpiece and raised contact surface are aligned to control workpiece thickness and other lapping parameters. In illustrated embodiments, the relative position of the workpiece and raised contact surface are aligned via an adjustment mechanism on the head structure. In illustrated embodiments, the adjustment mechanism is configured to adjust a position of the workpiece relative to the raised contact surface.

13 Claims, 11 Drawing Sheets

LAPPING DEVICE WITH LAPPING CONTROL FEATURE AND METHOD

BACKGROUND

Manufactured components are lapped to remove excess material to control thickness and other parameters of the fabricated components. Illustrative components include slider bars having a row of transducer heads. The bar is lapped to control the taper and bow of the slider bar and the thickness of the individual transducer heads fabricated from the slider bar. During the lapping process, the bar is supported against an abrasive lapping surface. Relative movement between the bar against the abrasive lapping surface removes or abrades a layer of material from the bar. The amount or thickness of the material removed is dependent upon the abrasion of the lapping surface and lapping time. Lapping time is increased to increase the thickness of material removed or the lapping time is decreased to reduce the thickness of material removed. For slider bars or components, a pre-set lapping time is used to control the lapping process and thickness of material removed. Variations in the bar dimensions and parameters can introduce variations in the thickness dimensions of the transducer heads fabricated using the pre-set lapping time. Embodiments of the present invention provide solutions to these and other problems, and offer other advantages over the prior art.

SUMMARY

The application relates to a head structure for a lapping device including a lapping control feature. As described, the lapping control feature includes a raised contact surface elevated from a front surface of the head structure. A relative position of the workpiece and raised contact surface are aligned to control workpiece thickness and other lapping parameters. The relative position of the workpiece and raised contact surface are aligned via an adjustment mechanism on the head structure. In illustrated embodiments, the adjustment mechanism is configured to adjust a position of the workpiece relative to the raised contact surface. In one embodiment described, the position of the workpiece is adjusted by adjusting an elevation of carrier supports that retain a carrier for the workpiece on the head structure. Prior to lapping, the elevation of the carrier supports is adjusted using a gauge block. Utilizing the gauge block, the carrier supports are adjusted so that the raised contact surface is aligned at a desired thickness of the workpiece. In embodiments shown, the raised contact surface on the head structure includes a plurality of contact pads. In illustrated embodiments, the plurality of contact pads are formed of a ceramic material or other material similar to the workpiece.

Other features and benefits that characterize embodiments of the present invention will be apparent upon reading the following detailed description and review of the associated drawings.

BRIEF DESCRIPTION OF THE DRAWINGS

FIG. 6A illustrates the head structure in a top perspective view, FIG. 6B illustrates the head structure in a top plan view with a carrier inset in the head structure for supporting the workpiece, FIG. 6C illustrates the head structure in top plan view with the carrier removed and FIG. 6D illustrates a bottom plan view of the head structure and the lapping control feature.

DETAILED DESCRIPTION OF ILLUSTRATIVE EMBODIMENTS

The present application relates to a lapping assembly 100 or process utilizing a lapping control feature. Embodiments of the lapping assembly 100 or process disclosed have application for lapping miniature components such as a slider bar for fabrication of transducer heads for data storage devices. Although embodiments of the present application are described for lapping slider bars for fabrication of transducer heads, application is not limited to slider bars and embodiments of the lapping control feature described in the application can be implemented to control thickness or dimensions for other workpieces.

Figure 1A:
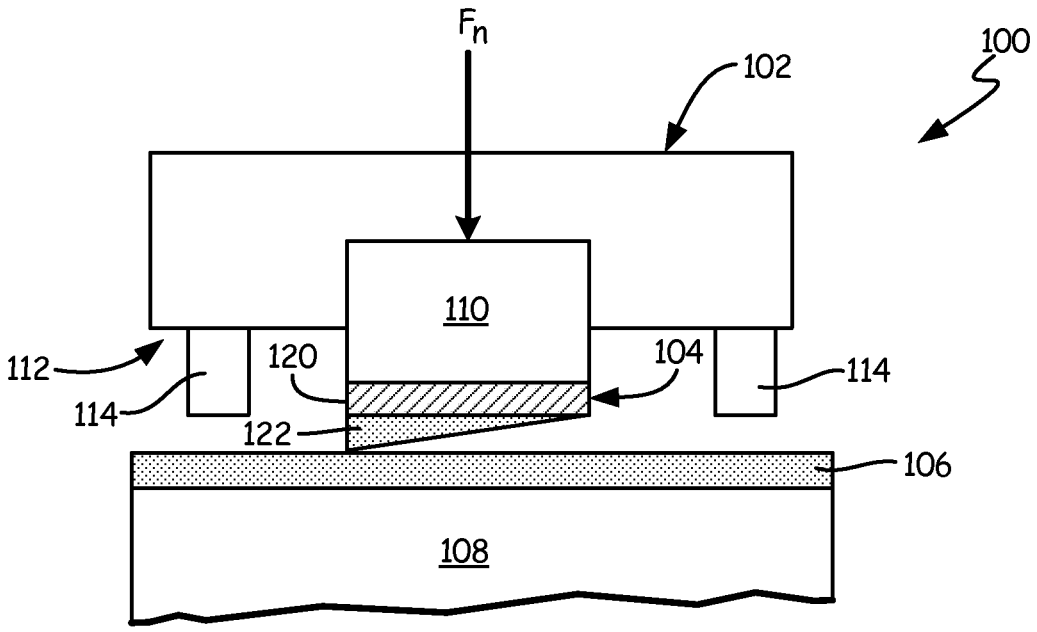
FIGS. 1A and 1B schematically illustrate a lapping structure including a lapping control feature for controlling lapping parameters for lapping a workpiece.
Figure 1B:
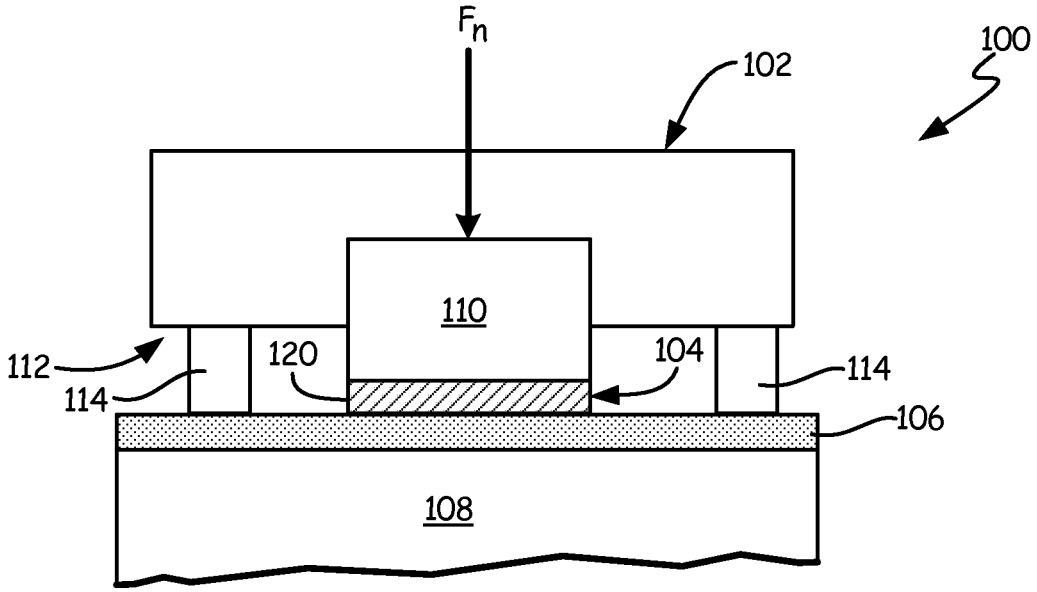

FIGS. 1A-1B illustrate an embodiment of the lapping assembly 100 having the lapping control feature to control lapping parameters or dimensions of a workpiece. As schematically illustrated in FIGS. 1A-1B, the lapping assembly 100 includes a head structure 102 that supports a workpiece 104 for lapping. The head structure 102 moves (or rotates) relative to an abrasive lapping surface 106 to abrade a surface layer of material from the workpiece 104. As shown, the abrasive lapping surface 106 is formed of an abrasive material or surface on an outer surface of a rotating platen 108. In an illustrated embodiment, relative motion between the workpiece 104 and abrasive lapping surface 106 is imparted via rotation of both the platen 108 and the head structure 102 supporting the workpiece 104, however application is not limited to rotation of both the platen 108 and head structure 102, and in illustrative embodiments, one of the head structure 102 or platen 108 rotates to engage the workpiece 104 along the abrasive lapping surface 106.

As shown in FIGS. 1A-1B, the workpiece 104 is coupled to the head structure 102 through a carrier 110. The workpiece 104 and carrier 110 form a carrier/workpiece unit which is coupled to and supported by the head structure 102 for lapping. During the lapping process, a force $F_n$ is applied to the carrier/workpiece unit to bias the workpiece 104 towards the abrasive lapping surface 106. The relative movement of the workpiece 104 and abrasive lapping surface 106 abrades material generally at a lapping rate dependent upon the workpiece material, abrasion of the abrasive lapping surface 106 and lapping time. For small or miniature components, such as a slider bar or transducer head, precise control of the lapped thickness and the lapping process is important to reduce tolerance variations. In the embodiment shown in FIGS. 1A-1B, the head structure 102 includes a raised contact surface elevated from a front surface 112 of the head structure 102 to form the lapping control feature. In the embodiment shown, the raised contact surface includes one or more contact pads, such as the pair of contact pads 114 illustrated in FIGS. 1A-1B.

Prior to lapping, the workpiece 104 includes a gauge thickness 120 and an additional thickness 122. The gauge thickness 120 corresponds to a desired thickness of the workpiece 104 and the additional thickness 122 corresponds to the thickness to be removed by the lapping process. The one or more contact pads 114 and workpiece 104 are aligned to remove the additional thickness 122 during the lapping process but not the gauge thickness 120. Thus, as comparatively illustrated in FIGS. 1A-1B, during the lapping process, the additional thickness 122 is progressively removed until the raised contact surface or contact pads 114 engage or contact the abrasive lapping surface 106 as shown in FIG. 1B. Contact between the abrasive lapping surface 106 and the raised contact surface or pads 114 inhibits further material removal from the workpiece 104 to control the lapped thickness of the workpiece 104 to correspond to the gauge thickness 120.

In an illustrated embodiment, the one or more contact pads 114 are formed of a similar material to the workpiece 104. For example if the workpiece is a ceramic slider bar, the one or more contact pads 114 are formed of a ceramic material. Force $F_n$ is supplied to bias the workpiece 104 against the abrasive lapping surface 106 and distribute load across the workpiece 104 to provide a uniform thickness and flatness. As shown in FIG. 1B, as the lapped workpiece 104 reaches the gauge thickness 120 and the raised contact surface or pads 114 contact the abrasive lapping surface 106, the lapping force is transferred to the raised contact surface or pads 114 to reduce the lapping force applied to the workpiece 104. The reduced lapping force or pressure following contact provides a uniform workpiece thickness, and more uniform shape, stress and surface finish along the workpiece 104.

Figure 2A:
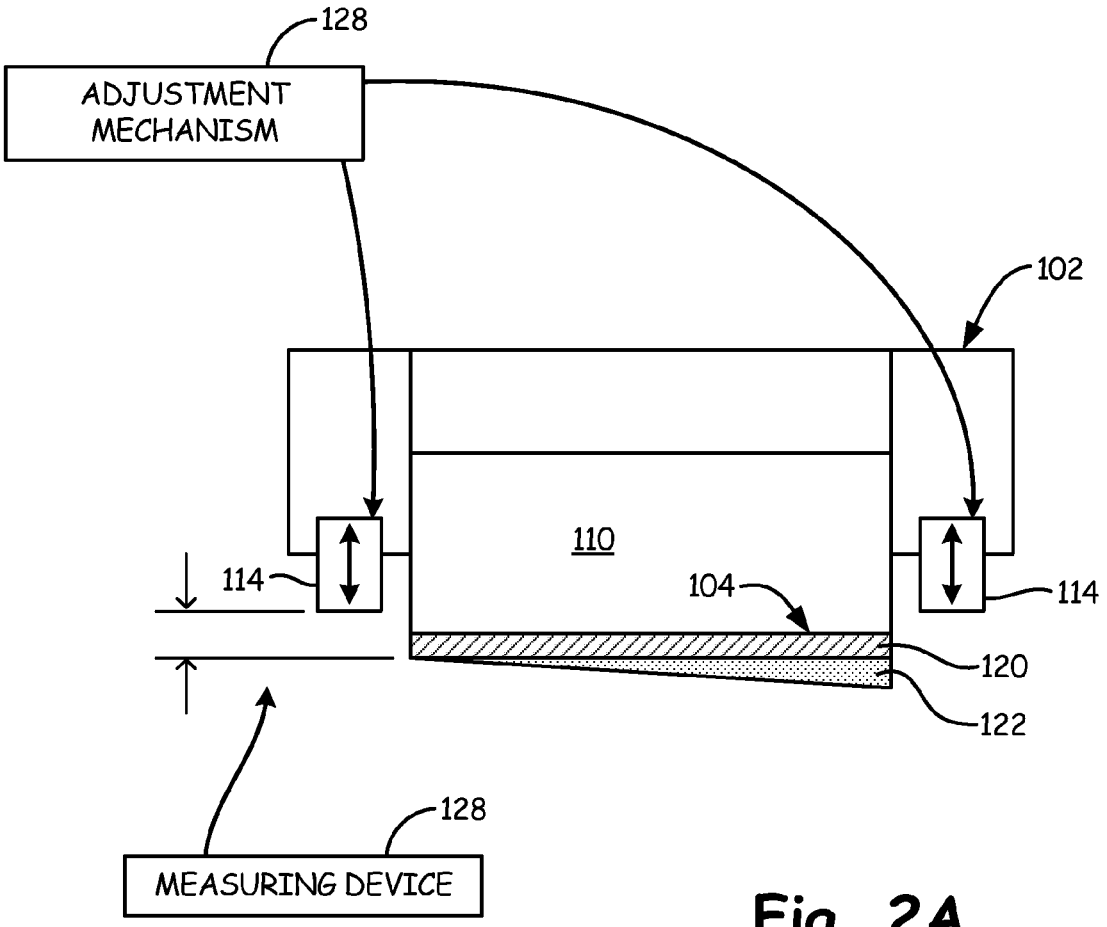
FIGS. 2A-2B illustrate embodiments of a lapping structure including an adjustment mechanism for adjusting a relative position of a workpiece and the lapping control feature.
Figure 2B:
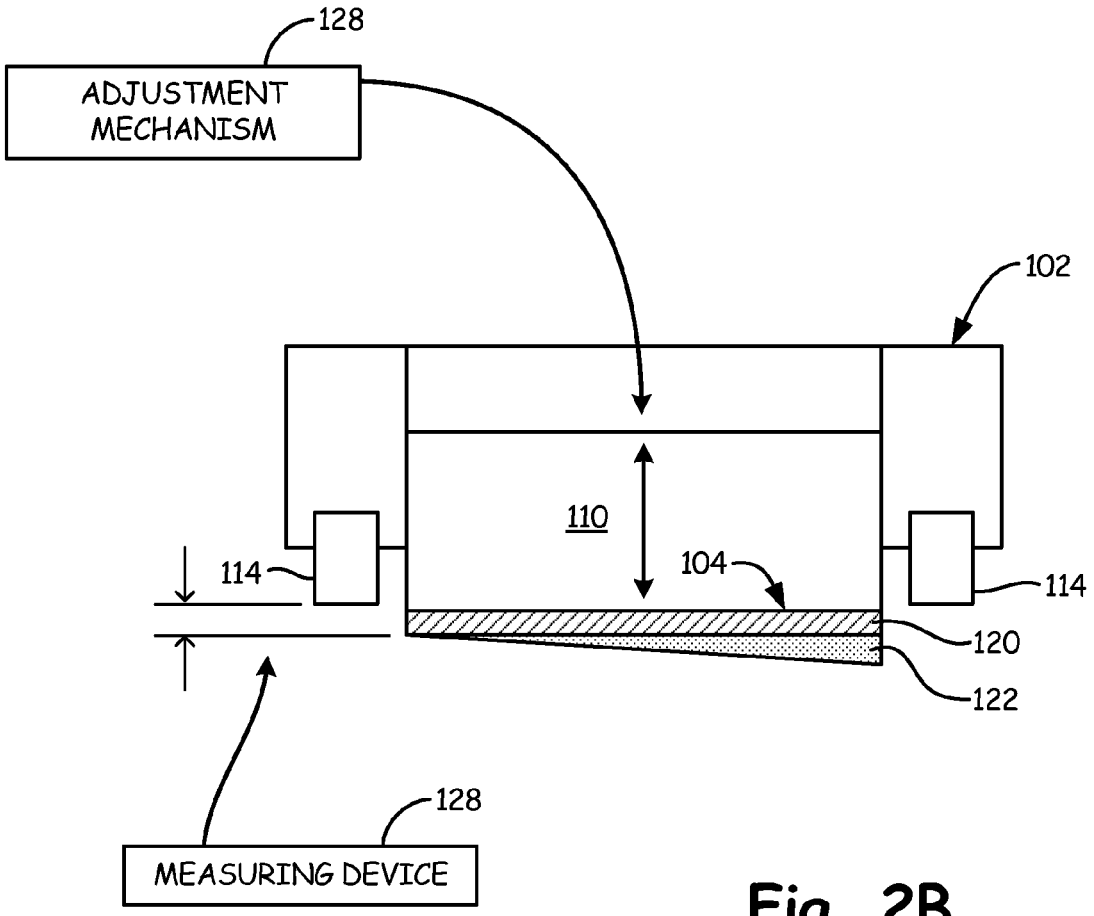

As schematically illustrated in FIGS. 2A-2B, the raised contact surface or one or more contact pads 114 and workpiece 104 are aligned by either adjusting the position of the one or more contact pads 114 with respect to the workpiece 104 through adjustment mechanism 126 coupled to the contact pads 114 as schematically illustrated in FIG. 2A or by adjusting the position of the workpiece 104 with respect to the raised contact surface or pads 114 via adjustment mechanism 126 coupled to the workpiece 104 as schematically illustrated in FIG. 2B. In the illustrated embodiments, a measuring device 128 is used to adjust the relative position of the one or more contact pads 114 and the workpiece 104 as shown in FIGS. 2A-2B. In an illustrative embodiment, the measurement device 128 is an optical or laser measuring device. Based upon the measured position, the position of the workpiece 104 or pads 114 is adjusted by positioning mechanisms 126 so that the one or more contact pads 114 inhibit lapping below the gauge thickness 120 of the workpiece 104 as previously described.

Figure 3A:
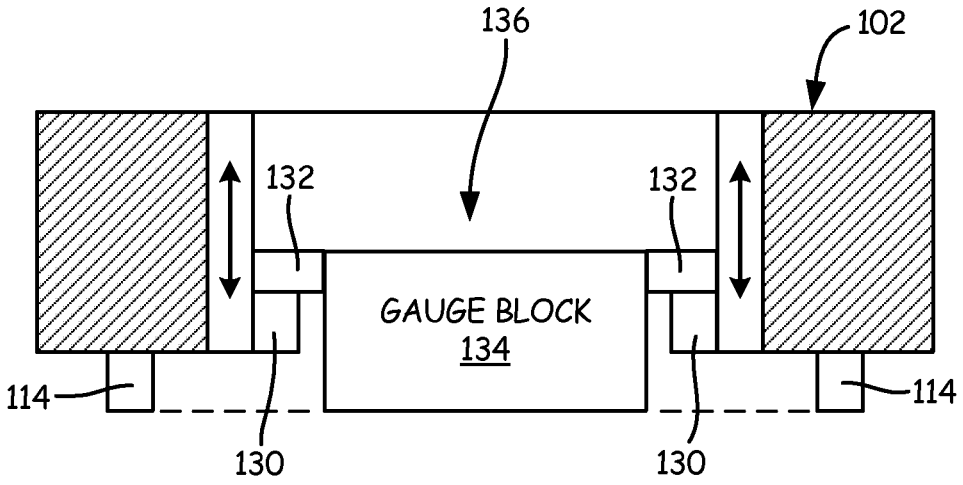
FIGS. 3A-3B illustrate an embodiment of the lapping structure including an adjustment mechanism for adjusting a position of carrier supports relative to the lapping control feature to control the lapping parameters or thickness of the workpiece.
Figure 3B:
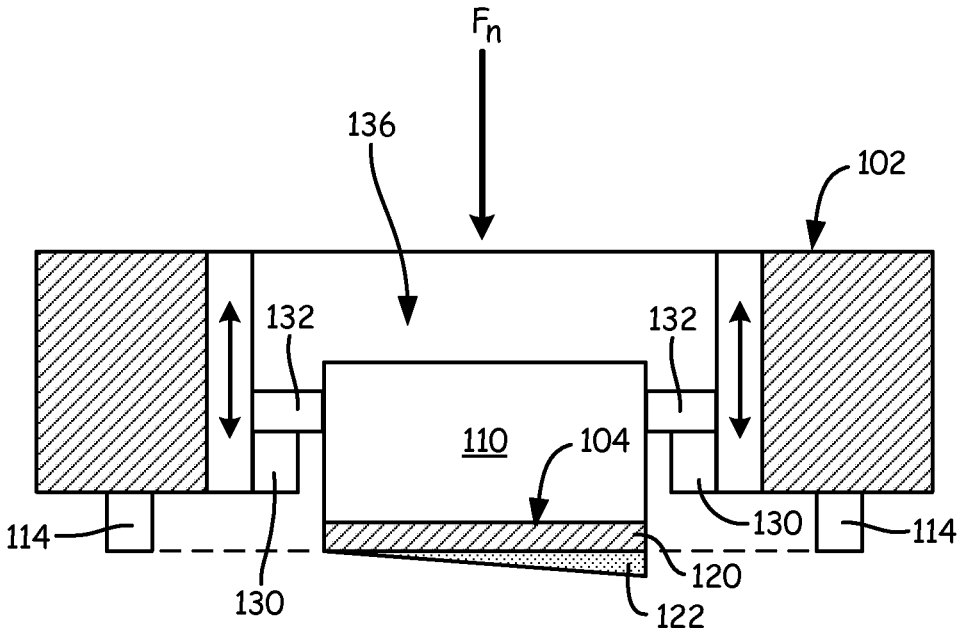

FIGS. 3A-3B illustrate an embodiment of the adjustment mechanism configured to adjust the position of the workpiece 104 relative to the one or more contact pads 114 through adjustment of the carrier 110 relative to the head structure 102. As shown, the head structure 102 includes one or more adjustable carrier supports 130. The carrier supports 130 as shown provide support surfaces for one or more support projections 132 extending from a gauge block 134 shown in FIG. 3A for alignment and support projections 132 extending from a main body of the carrier 110 shown in FIG. 3B for lapping. As shown, the carrier supports 130 are vertically adjustable to adjust the vertical position of the carrier support 130 and thus the elevation of the carrier/workpiece unit relative to the one or more contact pads 114 utilizing the gauge block 134.

In the illustrated embodiment shown in FIGS. 3A-3B, the carrier supports 130 extend into an opening 136 of the head structure 102. Opening 136 is sized to receive the gauge block 134 shown in FIG. 3A and the carrier/workpiece unit shown in FIG. 3B. Carrier supports 130 extend into the opening 136 to restrict passage of the gauge block 134 and carrier 110 therethrough. Prior to lapping, the gauge block 134 is used to adjust the elevation of the carrier supports 130 for lapping. The gauge block 134 is formed of a solid body having a height that corresponds to the height of the carrier 110 and gauge thickness 120 of the workpiece 104. The elevation of the carrier supports 130 is adjusted until a front surface of the gauge block 134 aligns with a front surface of the contact pads 114 as shown in FIG. 3A. In an illustrated embodiment, the gauge block 134 is formed of a gold standard block to precisely align the carrier supports 130 for lapping.

Once the carrier supports 130 are aligned utilizing the gauge block 134, the carrier/workpiece unit is inserted into the opening 136 so that the support projections 132 on the carrier 110 rest on the carrier supports 130 for lapping as illustrated in FIG. 3B. During the lapping process, force $F_n$ is applied to the carrier 110 to bias the support projections 132 against the carrier supports 130 to secure the carrier 110 to the head structure 104 for lapping and bias the workpiece 104 against the abrasive lapping surface 106. As previously described, in an alternate embodiment, the position of the one or more contact pads 114 or raised contact surface is adjusted to implement the lapping control feature to control the lapping parameters of the workpiece and application is not limited to the embodiment shown in FIGS. 3A-3B.

Figure 4A:
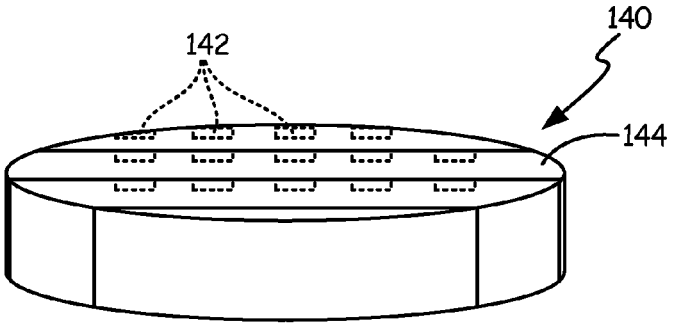
FIGS. 4A-4B illustrate transducer head components including a slider bar shown in FIG. 4B cut from a wafer structure shown in FIG. 4A.
Figure 4B:
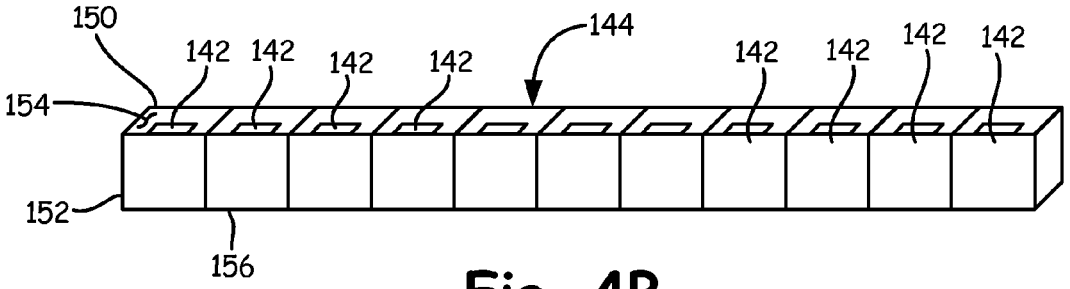

The lapping structure described is used to lap components for transducer heads for data storage devices. As shown in FIG. 4A, transducer heads are typically fabricated on a wafer substrate 140. Transducer elements 142 (illustrated diagramatically) of the heads are deposited or formed on a surface of the wafer substrate 140 using thin film deposition techniques. Following deposition of the transducer elements 142, the wafer 140 is sliced into bars 144 as shown in FIG. 4B. The sliced bars 144 have a leading edge 150, a trailing edge 152, air bearing surface 154 and a back surface 156. Slider bars 144 are lapped to control the thickness of the bar as well as to enhance flatness, bow and perpendicularism of the air bearing surface 156 and back surface 158 of the bar 144. The lapped bar 144 is then sliced to form the individual transducer heads of the data storage device.

Figure 5:
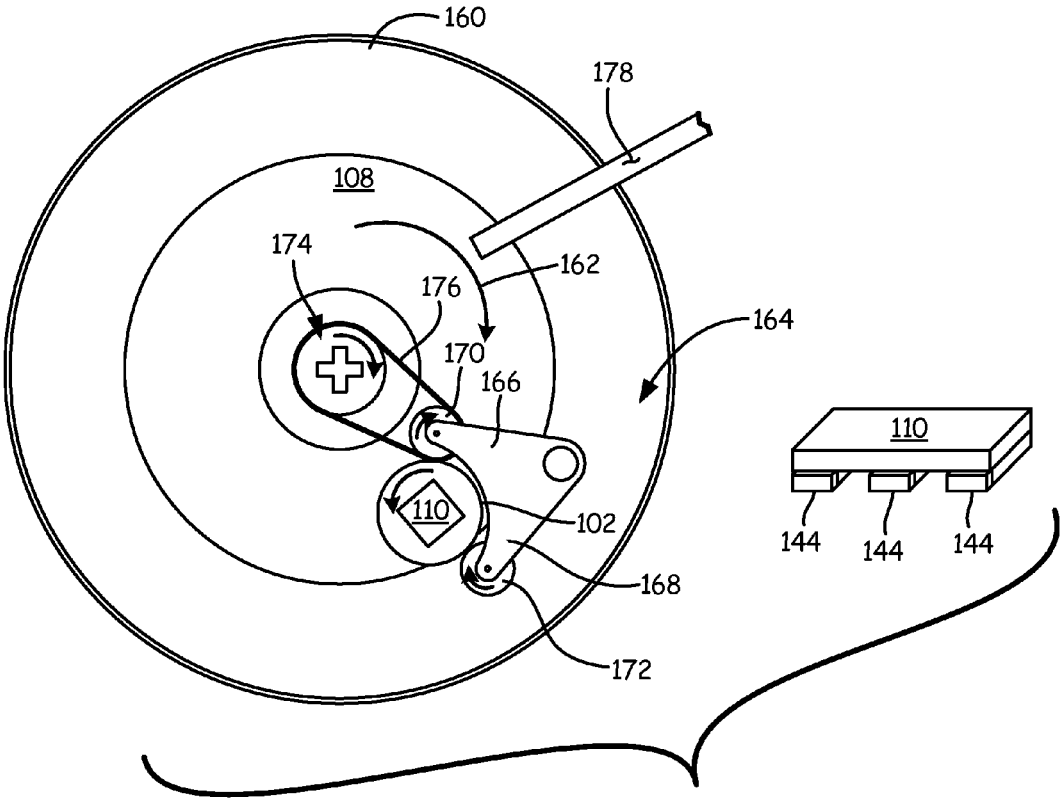
FIG. 5 illustrates an embodiment of a lapping device including a head structure having the lapping control feature for controlling the lapping parameters for fabricating head components illustrated in FIGS. 4A-4B.

FIG. 5 illustrates an embodiment of a lapping assembly utilizing the head structure 102 with the lapping control feature described (not shown in FIG. 5). The device includes the platen 108 (and abrasive lapping surface) disposed in a container 160. The platen 108 is rotated relative to the base of the container 160 as illustrated by arrow 162 via a motor (not shown). The head structure 102 is supported on the abrasive lapping surface 106 of the platen 108 and is retained on the platen surface by a fixture 164 connected to the base of the container 160. As shown, fixture 164 is V shaped to form multiple arms 166, 168 spaced to form an opening for the head structure 102. The head structure 102 is supported in the opening between rollers 170, 172 rotationally coupled to the distal end of arms 166, 168, respectively. The head structure 102 is rotated through a rotating shaft 174 disposed in the container 160.

Rotation of the shaft 174 is transmitted to the head structure 102 through a transmission line 176 connecting the rotating shaft 174 to roller 170. Rotation of shaft 174 rotates roller 170 to impart rotation to the head structure 102. Thus, in the illustrated embodiment, roller 170 forms a powered roller and roller 172 forms a passive roller. In the embodiment shown, shaft 174 rotates in unison with platen 108 through the motor (not shown). As schematically shown, lubricant is supplied from a supply line 178 for lapping. As schematically shown in FIG. 5, multiple bars 144 are connected to the carrier 110, which is coupled to the head structure 102 for lapping as previously described.

Figure 6A:
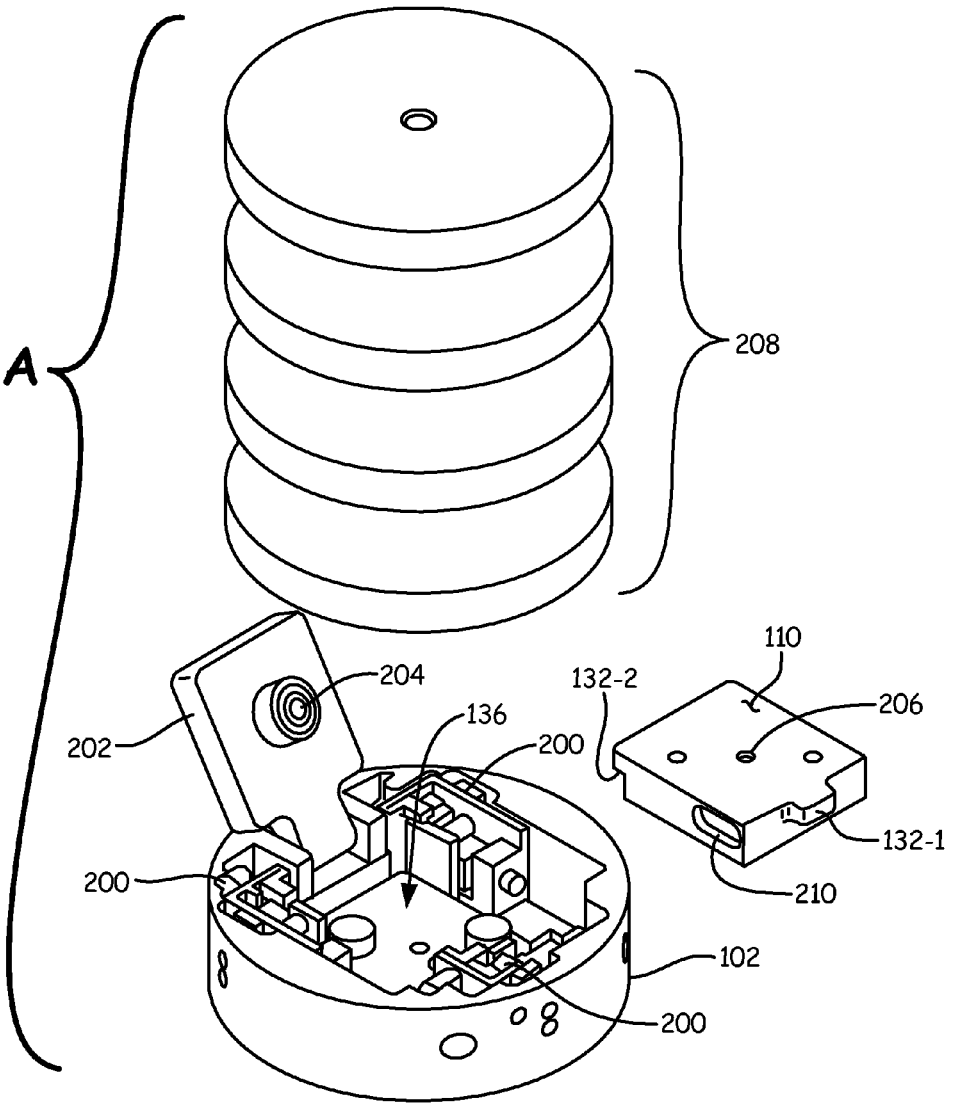
FIGS. 6A-6D illustrate an embodiment of the head structure including adjustable carrier supports for adjusting the relative position of the workpiece and the lapping control feature where
Figure 6B:
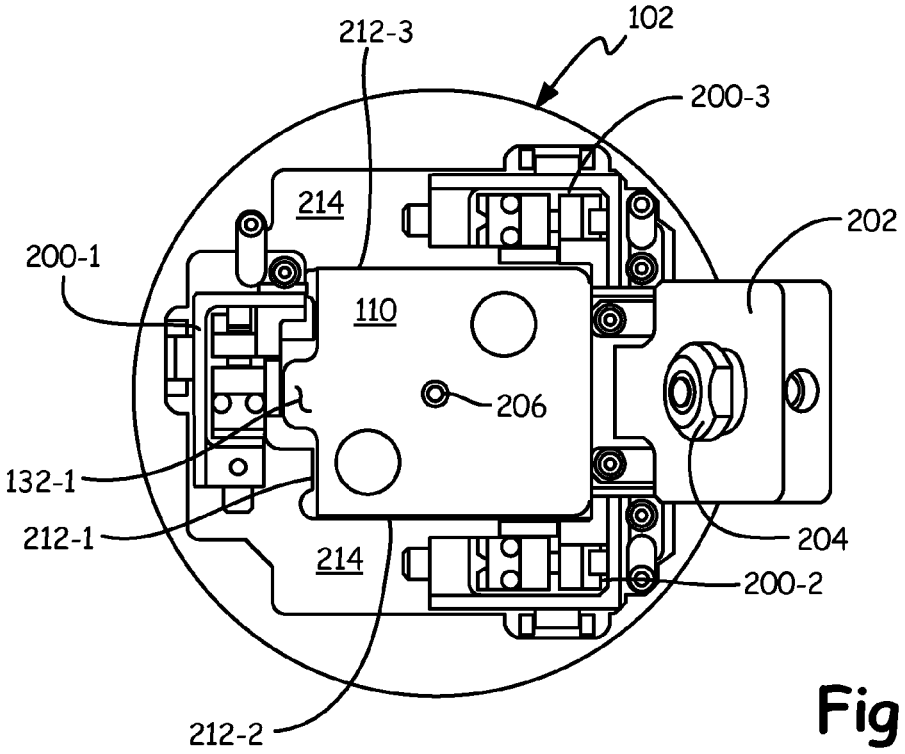
Figure 6C:
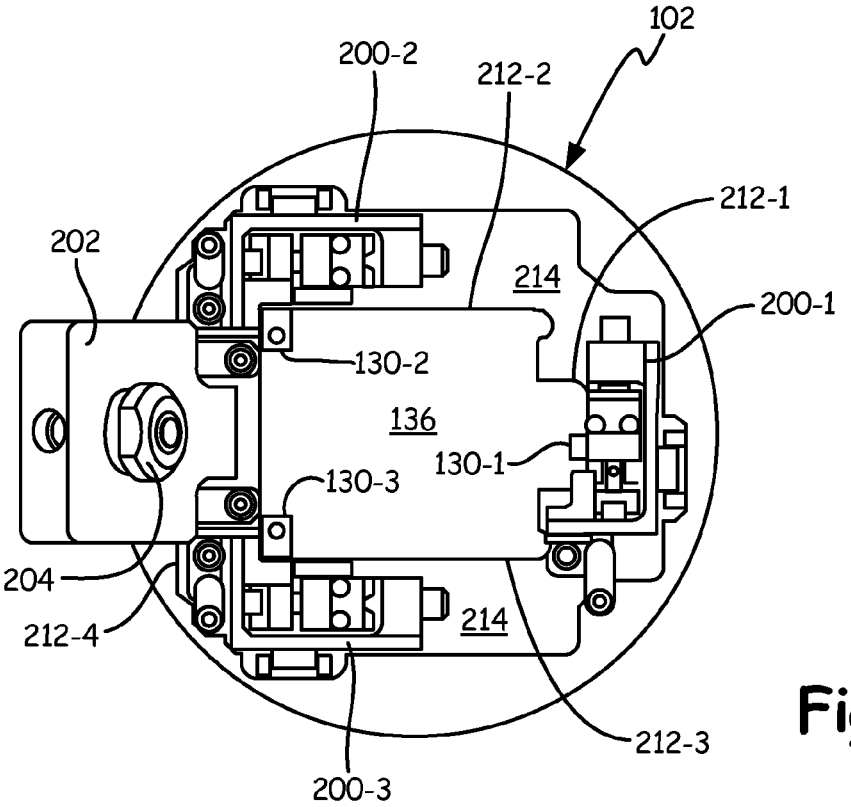

FIGS. 6A-6D illustrate a detailed embodiment of a head structure 102 with adjustable carrier supports 130 (visible in FIG. 6C) to adjust the position of the workpiece 104 relative to the raised contact surface or pads 114. As shown in FIGS. 6A-6C, the head structure 102 includes the carrier supports 130 (not shown in FIGS. 6A-6B) extending into opening 136 and adjustable through adjustment mechanisms 200 along sides of the opening 136. As shown, a weight applicator plate 202 is pivotally coupled to the head structure 102 to pivot between an open position and a closed position (not shown). In the open position shown in FIGS. 6A-6C, the opening 136 is accessible to inset the carrier 110 or gauge block 134 and in the closed position a ball plunger 204 on the plate 202 is biased against the carrier 110 within a ball socket 206 on the carrier 110.

As shown in FIG. 6A, one or more weights 208 are supported on the load applicator plate 202 in the closed position to bias the carrier 110 against the carrier supports 130 to retain the carrier 110 in the head structure 102 for lapping. The one or more weights 208 evenly distribute the lapping force to provide a uniform thickness and stress along a length of the workpiece as described. In the embodiment shown, the carrier 110 includes two support projections 132-1, 132-2 extending from opposed ends of the carrier 110 to engage the carrier supports 130 for lapping. In an illustrated embodiment, the gauge block 134 has a similar construction and projections 132-1, 132-2 as the carrier 110 for alignment of the workpiece 104 and raised contact surface or pads 114. The carrier 110 (and gauge block 134) also includes handles 210 along sides of the carrier 110 to grab the carrier 110 to insert the carrier 110 into opening 136 of the head structure 102 for lapping.

FIG. 6B illustrates the head structure 102 with the carrier inset in opening and FIG. 6C illustrates the head structure with the carrier 110 removed. As shown in FIG. 6B-6C, opening 136 extends through the body 180 of the head structure 102 and forms sides 212-1, 212-2, 212-3, 212-4 enclosing the opening 136. In the illustrated embodiment shown in FIG. 6C, the carrier 110 includes three carrier supports 130-1, 130-2, 130-3 that engage support projections 132-1, 132-2 on carrier 110 and gauge block 134 (not shown). In the illustrated embodiment, carrier support 130-1 is formed along side 212-1. Carrier support 130-2 is formed along side 212-2 at the corner of side 212-2 with side 212-4 and carrier support 130-3 is formed along side 212-3 at the corner of side 212-3 and 212-4. In the illustrated embodiment, each of the carrier supports 130-1, 130-2, 130-3 is separately adjustable through multiple adjustment mechanisms 200-1, 200-2, 200-3. As shown in FIG. 6C, carrier support 130-1 is adjusted through adjustment mechanism 200-1 supported on ledge 214 along side 212-1. Carrier support 130-2 is adjusted through adjustment mechanism 200-2 along ledge 214 of side 212-2 and carrier support 130-3 is adjusted through adjustment mechanism 200-3 along ledge 214 of side 212-3.

Figure 6D:
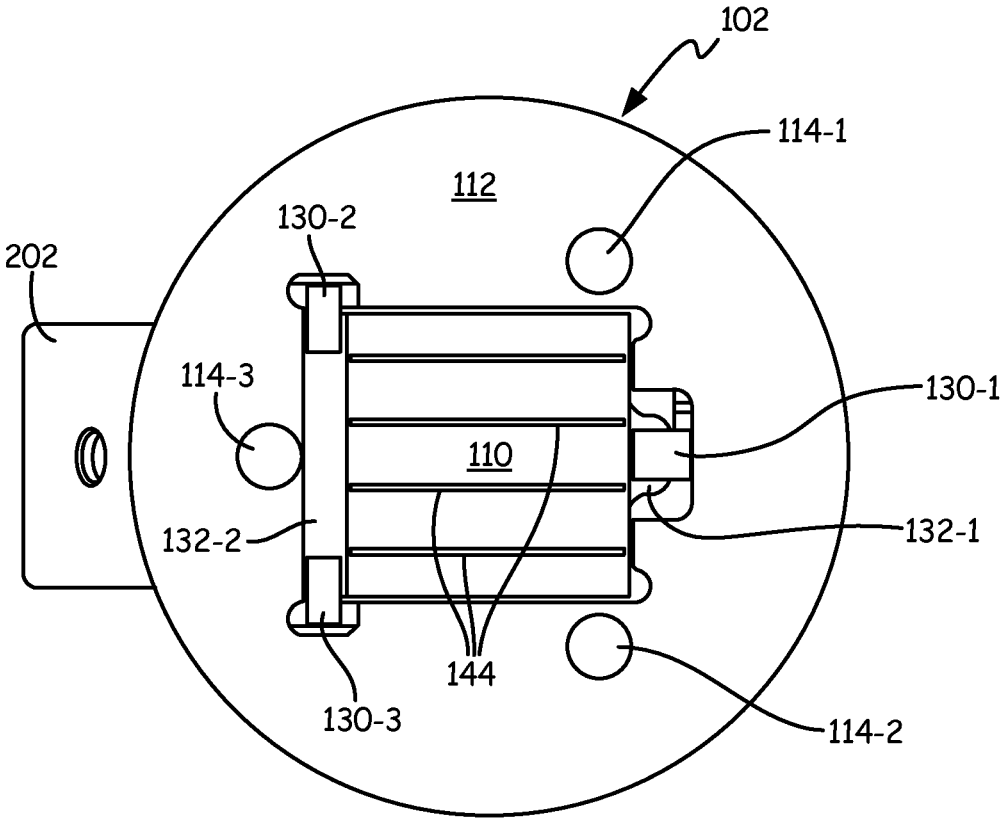

FIG. 6D illustrates a front surface 112 of the head structure 102 which as shown includes three contact pads 114-1, 114-2, 114-3. Carrier support 130-1 is spaced between contact pads 114-1, 114-2 at a first end of the carrier 110 and contact pad 114-3 is placed between carrier supports 130-2, 130-3 at a second end of the carrier 110. As shown, slider bars 144 are attached to the front surface 112 of the carrier 110 so that the ends of the bars 144 align with the ends of the carrier 110. As shown contact pads 114-1, 114-2 are disposed at the first end of the carrier and contact pad 114-3 is disposed at the second end of the carrier 110 to form mechanical end points for lapping the length of the bars extending between the mechanical end points. Contact pads 114-1, 114-2, 114-3 shown in FIG. 6D can be attached to the head structure 102 through an adhesive or other attachment and can be removed and replaced depending upon wear. In the illustrated embodiment, the contact pads 114-1, 114-2, 114-2 are round, however, application is not limited to round contact pads and alternate shaped pads can be utilized. In the illustration shown, only four slider bars 144 are shown on the carrier 110, however, application is not limited to four bars 144 and some carriers are design to hold as many as 44 bars.

Figure 7A:
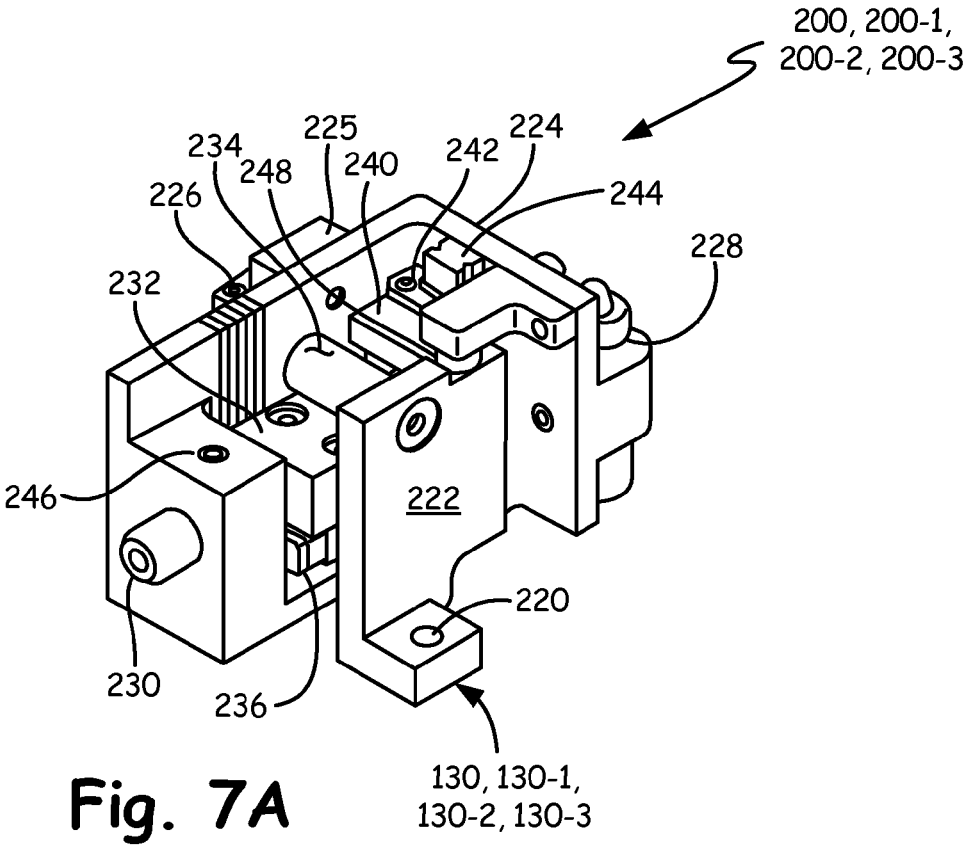
FIGS. 7A-7B illustrate an embodiment of an adjustment mechanism for adjusting the position of the carrier supports for the workpiece relative to the lapping control feature.
Figure 7B:
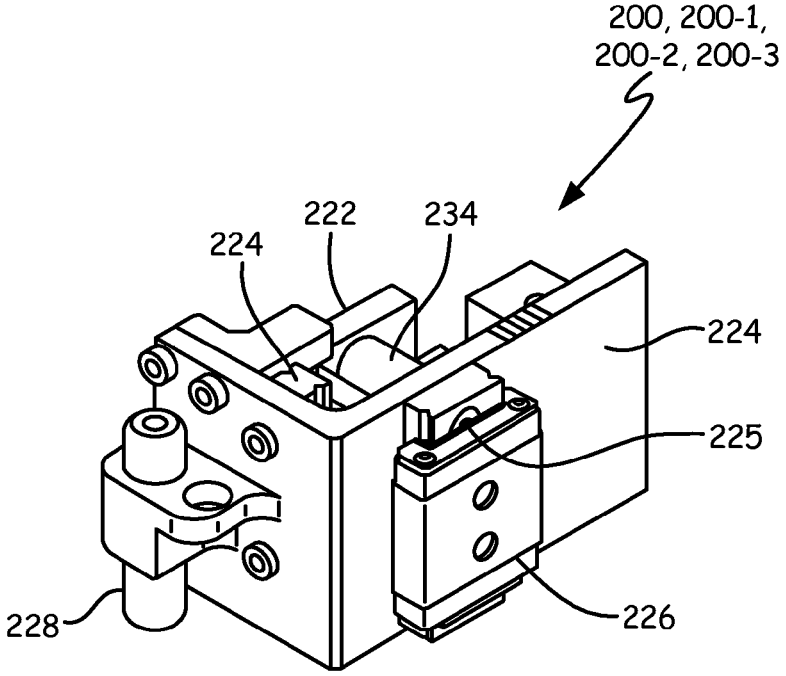
Figure 7C:
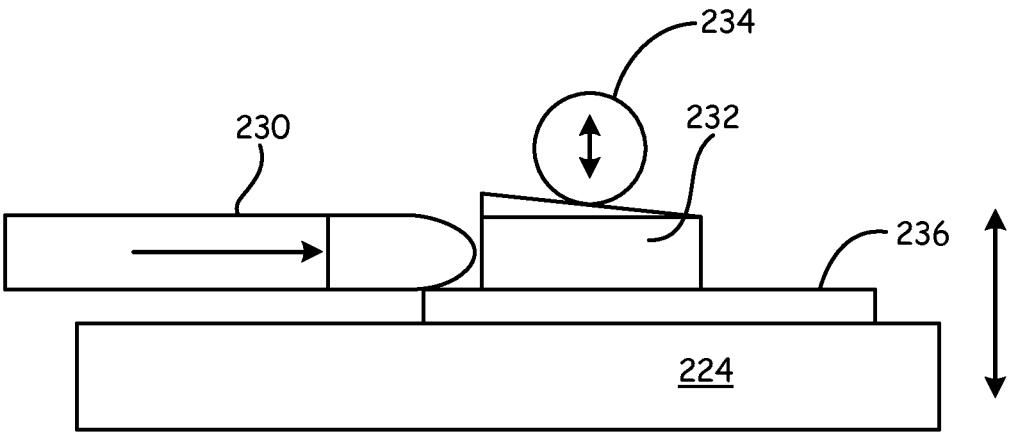
FIG. 7C schematically illustrates a threaded drive rod and wedged shaped block for adjusting a position of the carrier supports relative to a support block of the adjustment mechanism.

FIGS. 7A-7C illustrate an embodiment of the adjustment mechanisms 200, 200-1, 200-2, 200-3 for adjusting the elevation of the individual carrier supports 130, 130-1, 130-2, 130-3 on the head structure 102. As shown, the carrier supports 130, 130-1, 130-2, 130-3 include a contact ball 220 and are coupled to a bracket 222 which connects the carrier supports 130, 130-1, 130-2, 130-3 to a support block 224. Support block 224 is coupled to the head structure 102 through a rail assembly including an inner rail 225 connected to the support block 224 and an outer rail 226 connected to the head structure 102 to raise and lower the support block 224 relative to the head structure 102.

The elevation of the support block 224 is adjusted relative to the head structure 102 through an actuator device which as shown includes a threaded drive rod 228 coupled to the head structure 102 to form one or more drive components to raise and lower the carrier supports 130, 130-1, 130-2, 130-3 through the support block 224. As shown, support block 224 includes a proximal portion, a distal portion and a side portion extending from a base of the block 224. The carrier supports 130, 130-1, 130-2, 130-3 are also raised and lowered through one or more drive components coupled to the support block 224 through one or more linkage component operably connecting the drive components on the support block 224 to the carrier support 130, 130-1, 130-2, 130-3.

In the illustrated embodiment, the one or more drive components on the support block 224 includes a threaded drive rod 230 coupled to a wedge shaped actuator block 232. The threaded drive rod 230 and wedged shaped actuator block 232 form an actuator device to raise and lower the carrier supports 130, 130-1, 130-2, 130-3 relative to the support block 224. The drive rod 230 is moved between a retracted position and an extended position to move the wedged shaped actuator block 232 to raise and lower the carrier supports 130, 130-1, 130-2, 130-3. In illustrated embodiments, the one or more linkage components include a linkage pin 234 coupled to the bracket 222. Movement of the wedge shaped block 232 engages the pin 234 along the sloped surface of the wedge shaped block 232 as shown in FIG. 7C to raise and lower the carrier supports 130, 130-1, 130-2, 130-3 through connection of the pin 234 to the bracket 222 as shown in FIG. 7A. As shown in FIG. 7A, the wedge shaped block 232 is coupled to and movable along the base of support block 224 through a rail assembly 236.

In the illustrated embodiment, the bracket 222 is moveably coupled to support block 224 through a rail assembly coupled to a rail extension 240 on bracket 222 and the support block 224. The rail assembly includes an outer rail 242 coupled to the rail extension 240 and an inner rail 244 coupled to the support block 224. Movement of the pin 234 via the wedge shaped block 232 raises and lowers bracket 222 via movement of outer rail 242 coupled to bracket 222 along inner rail 224 connected to the support block 224 to raise and lower the carrier supports 130, 130-1, 130-2, 130-3. In an illustrated embodiment, a spring (not shown) biases the wedge shaped block 232 toward the distal portion of the support block 224.

As shown, rotation of the drive rod 230 is controlled through a set screw 246 in support block 224. Support block 224 includes a compressible body 248 that engages extension 240 of bracket 222 to control adjustment of the carrier support 130, 130-1, 130-2, 130-3 via drive rod 230 and wedged shape block 232. As previously discussed, the elevation of the support block 224 relative to the head structure 102 is adjustable via drive rod 228 coupled to the head structure 102 to provide the one or more drive component to raise or lower the elevation of the support block 224 (and carrier supports 130, 130-1, 130-2, 130-3 coupled to the support block 224) and operation of the threaded drive rod 230 provides drive components for finely adjusting the elevation of carrier supports 130, 130-1, 130-2, 130-3 relative to the lapping control feature.

Figure 8:
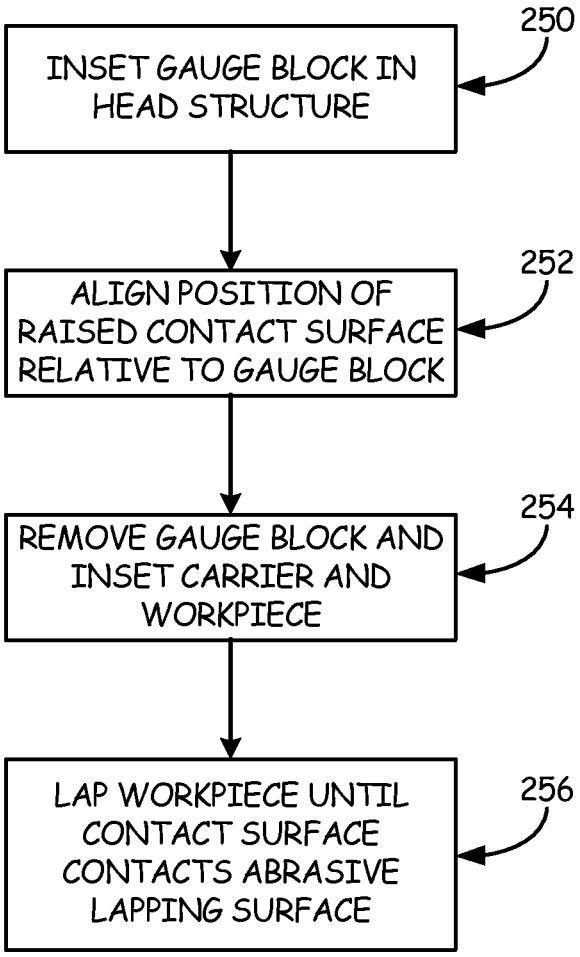
FIG. 8 illustrates a lapping process utilizing the lapping control feature on the head structure. It should be understood that the attached drawings are not necessarily drawn to scale and that certain features may be exaggerated for clarity.

FIG. 8 illustrates an embodiment of lapping process steps utilizing the lapping control feature to control the lapping process and parameters. As shown in FIG. 8, in step 250, the gauge block 134 is inset into the head structure 102 and the relative position of the raised contact surface or pad 114 and workpiece 104 are aligned in step 252 to provide contact between the raised contact surface and the abrasive lapping surface at the gauge or desired thickness of the workpiece 104. In embodiments described, the relative position of the raised contact surface and workpiece are aligned by adjusting the carrier support 130 for the carrier 110 holding the workpiece 104 on the head structure 102. The carrier supports 130, 130-1, 130-2, 130-3 are raised or lowered to adjust the elevation of the gauge block 134 so that the workpiece 104 is lapped to the gauge thickness 120 provided by the gauge block 134.

In an illustrated embodiment, the carrier supports 130, 130-1, 130-2, 130-3 are aligned utilizing the gauge block 134 while the head structure 102 is supported on a granite block to provide measurement and placement precision. Once the relative position is set, the gauge block 134 is removed in step 254 and the workpiece 104 and carrier 110 are inset into the head structure 102 and the head structure and/or platen is rotated to lap or abrade a surface layer of the workpiece 104. The workpiece 104 is lapped as shown in step 256 until the raised contact surface contacts the abrasive lapping surface 106 at the desired workpiece thickness.

It is to be understood that even though numerous characteristics and advantages of various embodiments of the invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the particular elements may vary depending on the particular application or workpiece while maintaining substantially the same functionality without departing from the scope and spirit of the present invention. In addition, although the preferred embodiment described herein is directed to lapping a slider bar, it will be appreciated by those skilled in the art that the teachings of the present invention can be applied to other miniature components or workpieces, without departing from the scope and spirit of the present invention.

What is claimed is:

1. A lapping assembly comprising:

a head structure configured to support a workpiece for lapping;

at least one contact pad on the head structure; and an adjustment mechanism on the head structure configured to adjust a relative position of the workpiece and the at least one contact pad, the adjustment mechanism comprising;

one or more adjustable carrier supports to support the workpiece on the head structure through a carrier including one or more support projections; and one or more drive components including a threaded drive rod operable to move a wedged shape block along a rail, wherein the wedge shaped block includes a sloped surface configured to engage a linkage pin coupled to the one or more carrier supports to raise and lower the one or more carrier supports relative to the at least one contact pad.

2. The lapping assembly of claim 1 wherein the head structure includes at least three contact pads extending from a front surface of the head structure.

3. The lapping assembly of claim 1 wherein the at least one contact pad is formed of a ceramic material.

4. The lapping assembly of claim 1 and further comprising a weight applicator plate coupled to the head structure including a ball plunger configured to engage the carrier for the workpiece to bias the carrier and the workpiece towards an abrasive lapping surface.

5. A lapping assembly comprising:

a head structure including a raised contact surface; and an adjustment mechanism configured to incrementally adjust a relative position of the raised contact surface and a workpiece coupled to the head structure, wherein the workpiece is coupled to the head structure through a carrier supported on one or more adjustable carrier supports coupled to the head structure through a support block movably coupled to the head structure through a rail assembly, and wherein the adjustment mechanism includes an actuator device configured to adjust an elevation of the support block relative to the head structure.

6. The lapping assembly of claim 5 wherein the raised contact surface includes a plurality of contact pads elevated from a front surface of the head structure.

7. The lapping assembly of claim 6 wherein the plurality of contact pads are formed of a ceramic material.

8. The lapping assembly of claim 5 and further comprising a weight applicator plate coupled to the head structure including a ball plunger configured to engage the carrier to bias the carrier and the workpiece toward an abrasive lapping surface.

9. A method comprising:

adjusting, by a gauge block, a relative position of a raised contact surface of a head structure and a carrier for a workpiece, wherein the gauge block is formed of a body having a height that corresponds to a height of the carrier and a gauge thickness of the workpiece; and lapping the workpiece coupled to the carrier until the raised contact surface engages an abrasive lapping surface.

10. The method of claim 9 wherein the step of adjusting the relative position of the raised contact surface and the carrier comprises:

placing the gauge block on adjustable carrier supports on the head structure; and adjusting an elevation of the adjustable carrier supports so that a front surface of the gauge block is aligned with the raised contact surface.

11. The method of claim 10 and following the step of adjusting the elevation of the carrier supports comprising:

removing the gauge block;

insetting the carrier onto the head structure so that the carrier is supported on the adjusted carrier supports; and biasing the carrier against the adjusted carrier supports for lapping.

12. The method of claim 11 comprising the step of:

adhering one or more workpieces on a front surface of the carrier for lapping prior to insetting the carrier onto the head structure.

13. A lapping assembly comprising:

a head structure including a raised contact surface; and an adjustment mechanism configured to incrementally adjust a relative position of the raised contact surface and a workpiece coupled to the head structure, wherein the workpiece is coupled to the head structure through a carrier supported on one or more adjustable carrier supports coupled to the head structure; and wherein the adjustment mechanism includes a threaded drive rod operable to move a wedge shaped block to raise and lower the adjustable carrier supports through one or more linkage components.

* * * * *